United States Patent [19]

Joseph, Jr.

[11] Patent Number: 4,618,142

[45] Date of Patent: Oct. 21, 1986

[54] JUMPROPE APPARATUS HAVING WEIGHTED BAR

[75] Inventor: Tony Joseph, Jr., Johnstown, Pa.

[73] Assignee: Jog & Lift Development Co., Johnstown, Pa.

[21] Appl. No.: 693,134

[22] Filed: Jan. 22, 1985

[51] Int. Cl.[4] ..... A63B 5/20; A63B 13/00

[52] U.S. Cl. ..... 272/75; 272/123; 272/128

[58] Field of Search ..... 272/74, 75, 123, 128, 272/93, 102, 103, 62; 24/135 R, 136 B

[56] References Cited

U.S. PATENT DOCUMENTS

| | | | |
|---|---|---|---|
| 67,101 | 7/1867 | Browne . | |
| 104,674 | 6/1870 | Whitehead . | |
| 1,230,561 | 6/1917 | Chige | 24/136 B |
| 2,493,224 | 1/1950 | Brunt et al. | 272/74 |
| 2,676,802 | 4/1954 | O'Brien | 272/84 |
| 2,719,038 | 9/1955 | Massa | 272/75 |
| 3,493,229 | 2/1970 | Ramsey | 272/74 |
| 3,554,539 | 1/1971 | Beutel | 272/62 |
| 3,762,704 | 10/1973 | Gingros | 272/75 |
| 3,904,198 | 9/1975 | Jones | 272/81 |
| 4,079,932 | 3/1978 | Schuetz | 272/75 |
| 4,094,502 | 6/1978 | Cook | 272/74 |
| 4,177,985 | 12/1979 | Hlasnicek | 272/75 |
| 4,178,687 | 12/1979 | Wallshein | 24/136 B |
| 4,184,677 | 1/1980 | Murray | 272/74 |
| 4,192,501 | 3/1980 | Peoples | 272/75 |
| 4,293,125 | 10/1981 | Hinds | 272/75 |
| 4,315,623 | 2/1982 | Granderson | 272/74 |
| 4,369,968 | 1/1983 | Price | 272/123 |

FOREIGN PATENT DOCUMENTS

| | | | |
|---|---|---|---|
| 249890 | 5/1948 | Switzerland | 272/128 |

*Primary Examiner*—Richard J. Apley
*Assistant Examiner*—S. R. Crow
*Attorney, Agent, or Firm*—Steele, Gould & Fried

[57] ABSTRACT

An exercise device having a jumprope mounted to a bar by means of rigid standoff rods also has means for receving a selected weight at either end of the bar. A user skipping the jumprope must manipulate both the rope and the weights. The quantity of weight, length of jumprope and the position of hand grips on the bar are all adjustable by the user. In one embodiment, the weights are radially offset from the bar, requiring the user to manipulate an unbalanced weight while skipping the rope.

14 Claims, 7 Drawing Figures

FIG. 1
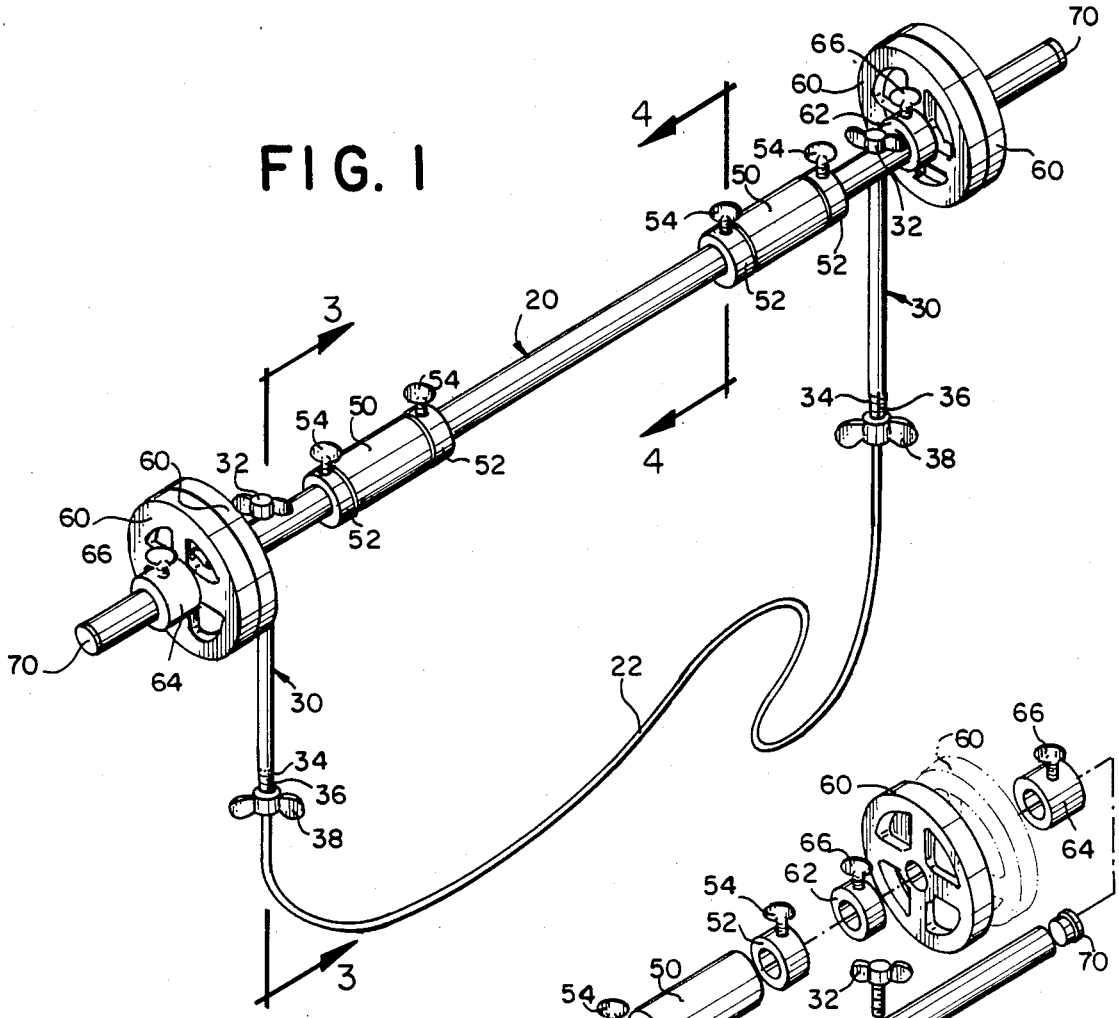
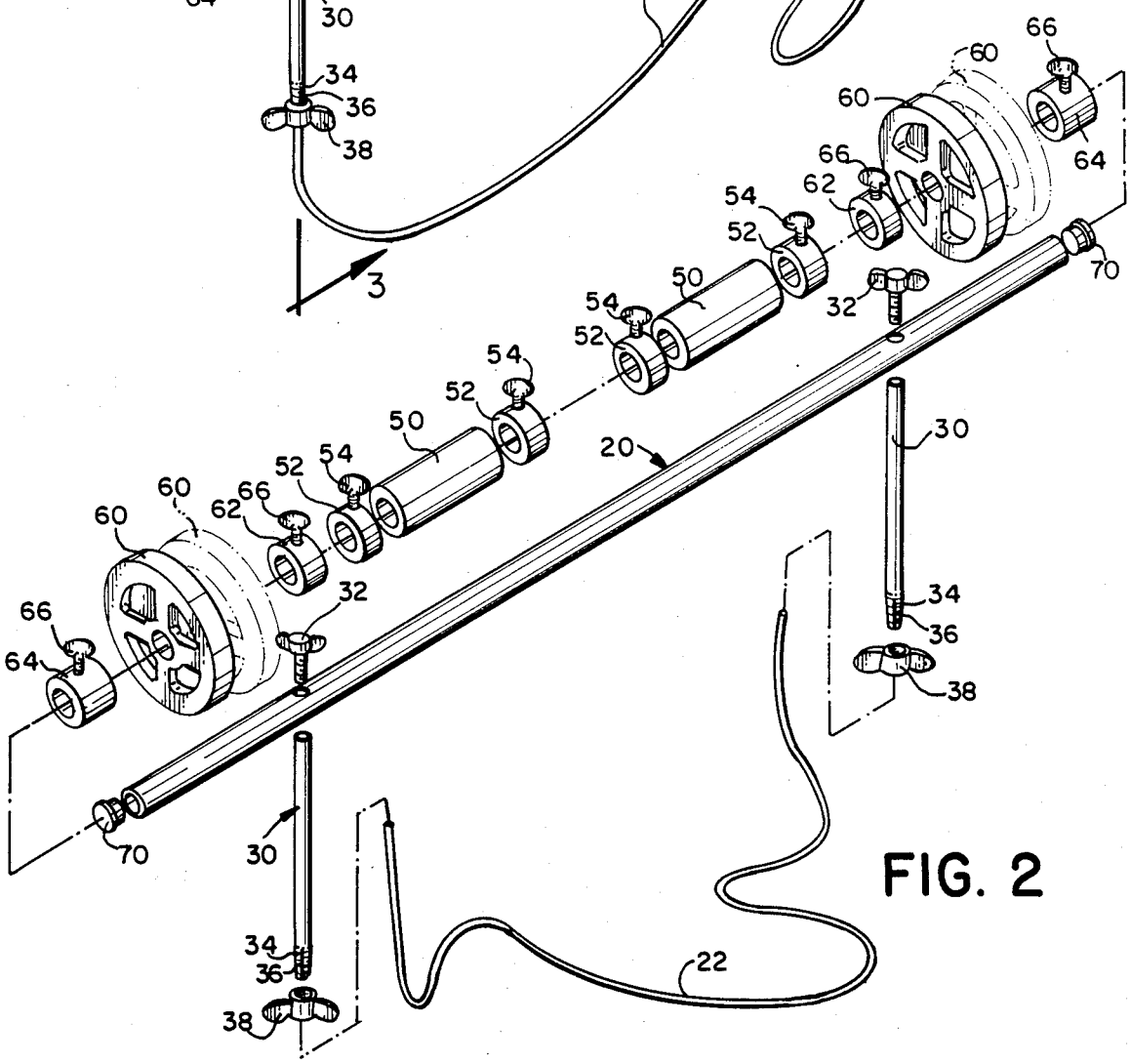
FIG. 2

JUMPROPE APPARATUS HAVING WEIGHTED BAR

BACKGROUND OF THE INVENTION

1. Field of the Invention

The invention relates to the field of exercise devices, and in particular to rope skipping apparatus. More particularly, the invention relates to a rope skipping apparatus based upon a horizontal bar around which a flexible hoop is rotated for skipping, the bar having means for receiving weights at either end thereof.

2. Description of the Prior Art

A variety of rope skipping devices based upon a horizontal bar having a hoop of flexible line attached thereto, are known in the prior art. In U.S. Pat. No. 4,315,623—Granderson, such a device also comprises hand grips rotatable with respect to the horizontal bar, the user being required to manipulate the flexible line around the bar while grasping the hand grips. Similar hoop-defining jump ropes are disclosed in U.S. Pat. No. 67,101—Browne; 104,674—Whitehead; 2,493,224—Brunt et al; 4,094,502—Cook, and others. Each of these devices includes the features of a horizontal bar and a hoop or flexible line running between the extreme ends of the bars, such that the user holds the bar horizontally while spinning the loop around the user's body.

The user of a bar-and-hoop rope skipping device according to the foregoing description normally has sufficient control to initiate the first swings of the rope even though the rope is attached directly to the ends of the bar. Some problems are encountered in certain situations, however, for example if an attempt is made to weight part of the device. Devices having weight means are disclosed, for example, in U.S. Pat. Nos. 4,079,932—Schuetz; 2,719,038—Massa, and others. These devices concern weighted handles, the flexible line (i.e., rope) being attached to otherwise-unconnected weight bodies. It is, of course, more difficult to jump a rope when extra weights are attached to the handles than to jump the same rope having simple unweighted handles. Unconnected weighted handles, however, are not well adapted for receiving an adjustable amount of weights, as are bar-type devices such as barbells. Therefore, the prior art has been restricted to the inconvenience of hollow handles for receiving a quantity of sand or fluent material (e.g., Schuetz), or in the alternative, inconvenient means such as bolts for rigidly attaching incremental weights to a handle (e.g., Massa).

If one simply attempts to weight a bar of the type forming part of a rope skipping hoop, one has certain difficulties in using the device. The familiar jumprope is altered drastically by the addition of weight to a selected portion thereof. In short, the inertia of the weighted part, e.g., the bar, is drastically increased, without a corresponding increase in mass of the remainder, e.g., the flexible line. Therefore, the flexible line accelerates quickly, while the bar does not. The line often simply tends to wrap around the bar, making jumping impossible. Furthermore, this occurs even when rotatable grips are provided to allow the bar to rotate freely in the user's grasp.

According to the invention, standoff support rods are provided for attaching a flexible line to a weighted bar of a hoop-type jumprope. The standoff rods are rigidly attached to the bar, at right angles. The standoffs apply additional leverage to the bar. Therefore, the effective inertia of the flexible line causes the bar to rotate as required, notwithstanding the increased inertia of weights thereon. The standoff rods also have the additional benefit of providing a means for adjusting the length of the flexible line and/or a means for changing the position of a flexible line of a given length, to avoid undue wear at a given spot on the line.

In U.S. Pat. No. 4,192,501—Peoples, an electric jumprope is disclosed in which an electric motor causes the rotation of an axial bar within a user-gripped tube, the internal axial bar having rigid standoff bars at either end thereof, extending past the ends of the tube. The device of Peoples requires less physical exertion of the user than even a conventional jumprope, and is therefore quite unlike the invention. Moreover, the need for Peoples' standoffs is directly related to the use of an internal torque-generating means, i.e., a motor. Inasmuch as the user is not attempting to swing the jumprope in an arc about his body, the lack of standoffs merely causes the motor to twist the rope, and not to initiate swinging. Therefore, Peoples' standoffs are necessary to the motorized function and are unrelated to those of the invention.

Recently, an exercise device known as the "Heavy Rope" has been marketed in which a simple length of flexible line is weighted by means of a fluent material. No rigid elements are employed. A flexible tube dimensioned similar to a garden hose, is filed with sand and cut to an appropriate length. Like the invention, the Heavy Rope increases the effort needed of the user to jump the rope. Therefore, more calories are burned during a given period of exercise. Nevertheless, the device has drawbacks. If the Heavy Rope is used for a period of time on a rough surface, the hollow flexible line will open and allow the catastrophic release of its contents. With the Heavy Rope fluent-filled line, or with prior art hollow handles, the user is required to attend line, or with prior art hollow handles, the user is required to attend to the filling and/or protection of the device from spills. Nowhere in the prior art is a device disclosed wherein the user is confronted with the difficulty of additional weight in a device that is practical for rope skipping, and has all the convenience of the adjustable-weight devices normally associated with barbells. According to the invention, however, a bar having means for receiving disk-shaped, barbell-type weights at either end thereof is provided with a rope skipping portion intermediate the weights. The additional inertia of the weights is overcome by standoffs rigidly attached to the bar by means of bolts passing through the bar to engage the standoff rods. The standoff rods are hollow such that frictional engagement means provided at their free ends allow the lengthwise adjustment of the loop of flexible line. Therefore, the user can receive the maximum benefit of his exercise time by the physical effort of additional weight, but enjoys the practicality of a balanced-inertia between bar and line and the convenience of easily-manipulated weights.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein:

FIG. 1 is a perspective view of a preferred embodiment of the invention.

FIG. 2 is an exploded perspective view of the device of FIG. 1, optional additional weights being shown in phantom.

SUMMARY OF THE INVENTION

Figure 3:
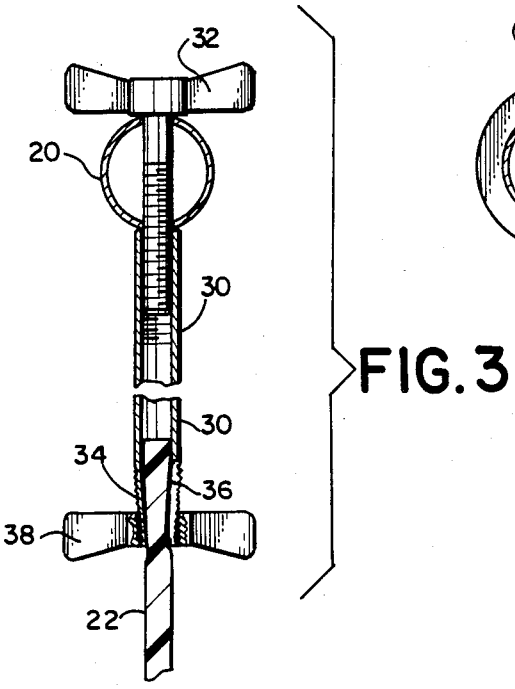
FIG. 3 is a partial section view taken along lines 3—3 in FIG. 1.
Figure 4:
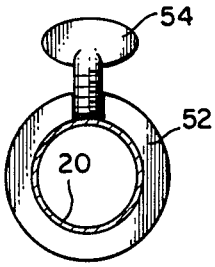
FIG. 4 is a partial section view taken along lines 4—4 in FIG. 1.

It is an object of the invention to provide a practical exercise device characterized by increased difficulty in its physical operation over known devices, but maximum convenience in manipulation of adjustable features therein.

It is also an object of the invention to provide a rope-skipping device of the bar-and-hoop variety in which the bar is provided with increased inertia over previous devices, without adding to risk that the bar and line will become fouled.

It is another object of the invention to provide a horizontal-bar jumprope device of increased difficulty in which the operating characteristics of the device can be altered using simple manually-operated fixtures, to exercise more and different parts of the user's anatomy.

These and other objects are accomplished by an exercise device having a jumprope mounted to a bar by means of rigid standoff rods. The bar is provided with means for receiving a selected weight at either end. The user skipping the jumprope must manipulate both the rope and the weights. The quantity of weight, length of jumprope and hand grip position are all adjustable by the user. In one embodiment, the weights are radially offset from the bar, requiring the user to manipulate an unbalanced weight while skipping the rope.

DETAILED DESCRIPTION OF THE PREFERRED EMBODIMENTS

As shown in FIG. 1, a preferred embodiment of the invention includes a straight bar 20, affixed to flexible line 22 such that line 22 can be rotated the axis of around bar 20, and means for receiving a plurality of weights 60 at either end of bar 20. The user simply grasps sleeves 50 which are freely rotatable with respect to bar 20 while holding it horizontal, and by moving bar 20, causes flexible line 22 to rotate in an arc around the user's body.

Bar 20 is preferably a length of stainless steel tubing, for example about 5 feet in length and one inch in outside diameter. Stainless steel is preferred for the necessary durability in that wear on the bar will occur during mounting and dismounting the weights, and during rotation of the bar within the hand grips. The bar need not be heavy of itself, whereby the user can optionally skip at a device weight similar to known devices. The bar can be made in several pieces, for example threadably attachable to one another.

According to the invention, the flexible line 22 to be skipped by the user is supported on posts 30, spaced from one another and spaced from the ends of the bar. Posts 30, which are at least 8–10 inches and preferably about 18 inches in length, are preferably rigidly attached to bar 20 at a right angle. Standoff posts 30 need not survive any particular friction, and accordingly, need not be made of stainless steel. Standoffs 30 are, however, hollow in order to receive a variable length of flexible line 22. Although standoffs 30 could be made rotatable around the bar as well, this is not preferred due to the additional wear caused and due to the effect on operation of the apparatus, for example the loss of inertia and inherent synchronism between standoffs 30.

In order to use the exercise device, the user stands in the closed loop defined by bar 22, standoffs 30 and flexible line 22, moving bar 20 horizontally and upwards, keeping the axis of bar 20 parallel to the ground, to cause line 22 to execute a first pass over (or under) the user. It should be noted that the user does not initiate swinging by twisting bar 20. The user grasps bar 20 by sleeves 50, each of which is freely rotatable with respect to the bar. Therefore, the initiation of swing is a matter of developing sufficient momentum in standoffs 30 and line 22 that line 22 will define a full 360 degree arc around bar 20. Following the first cycle, the line develops sufficient momentum that continung with jumping is somewhat easier.

A great deal of the inertia of the apparatus and momentum developed in swinging, is due to weights 60, attached at either end of the bar. The particular amounts and radial position of weights will affect the inertia substantially. Preferably, weights 60 are snugly mounted on the ends of the bar such that they rotate together with the bar. If they are loosely frictionally mounted, the weights will come up to speed with the bar a short time after initiation of rotation. It is also possible to provide a means of rotationally fixing the weight to the bar, for example, a key and slot arrangement fixing the weights to their adjacent sleeves 62, 64.

Inasmuch as the user is required to manipulate both the weights and the flexible line, exercising with the device of the invention is more difficult than either rope skipping (with or without a hoop-type skipping apparatus) or weight lifting. In addition to the aerobic and strength-building physical requirements of these two activities, the merging of the weight and skipping functions further requires the user to coordinate motions in a manner different than that needed for either lifting or skipping per se.

The particular hardware elements of a preferred embodiment, as illustrated in FIG. 1, are shown exploded in FIG. 2. In general, the weight and hand grip elements are slidably affixed to bar 20, and axially locked in position by means of sleeves bearing radially-directed thumb screws or the like, placed on either side of the element to be mounted on the bar. Rope or flexible line 22 and standoffs 30 are rigidly mounted to the bar at right angles. Standoffs 30 are hollow tubes, threaded internally at an end adjacent bar 20, and threaded externally on an opposite end. Bar 20 is bored perpendicular to its axis at a point spaced from either end, for receiving bolts 32. Bolts 32 may be wing bolts as shown, such that the entire device may be easily assembled and disassembled manually without tools. It is also, of course, possible to embody bolts 32 as screws, hex-head bolts, allen screws or the like, for use with tools.

Bolts 32 pass through bar 20, and are received within the internally-threaded end of standoff 30. This end may be cut to complement the curving surface of bar 20. The opposite or "outer" end of standoffs 30 is provided with a tapered and slotted, externally-threaded structure such that, together with a wing nut 38, the standoffs function as compression fittings for tightly engaging the ends of line 22. Inasmuch as the outer end of standoff 30 is slotted, the inside circumference of the tube can be increased and decreased by flaring or compressing the end, respectively. Wing nut 38 has a complementary tapered internal thread such that as wing nut 38 is threaded onto tapered thread 34, slots 36 are closed down on line 22, holding it in place.

The compression fitting attaching line 22 to standoff 30 by means of thread 34 and wing nut 38 allows line 22 to be extended for taller jumpers, and shortened for shorter jumpers. Moreover, during jumping, the outermost portion of line 22, which normally is the midpoint between the ends, repeatedly strikes against the ground or other surface on which the user jumps. Therefore, by changing the longitudinal position of flexible line 22 with respect to the standoffs (i.e., by storing a greater part within one or the other of standoffs 30, 30), a fresh part of line 22 can be positioned at the midpoint. In this manner, line 22 lasts longer.

Line 22 is preferably made of solid rubber, for example about three eights inch in diameter. It is also possible to use plastic line, a composite material, or simple twisted-fiber rope.

As shown in FIG. 2, the hand grip and weight elements are positioned directly on bar 20. The hand grips 50, which are preferably bushings in the form of tubular metal sleeves of a diameter only slightly larger than that of bar 20, are slided along bar 20 to a point between standoffs 30 (i.e., prior to attachment of both standoffs), and remain rotatable with respect to bar 20. Sleeves 50 may be freely axially-movable as well as rotatable with respect to bar 20, such that the user can position the sleeves 50 close together for one exercise regime, and far apart for another, thereby exercising different muscles. The exercise can also require rythmically changing the grip spacing or reversing the grasping direction during the exercise itself.

Preferably, the axial position of sleeves 50 along bar 20 is adjustable but is normally set at a predetermined position defined by the user by positioning handle-keeper sleeves 52. Keeper sleeves 52 are provided for each side of rotatable sleeves 50, defining the inner and outer extremes of travel of sleeves 50. Keepers 52 are rigidly attachable to the bar 20 by means of thumb screws 54, which pass through threaded bores in sleeves 52 to bear against bar 20. The keepers may be snugly fit against sleeves 50, thereby fixing sleeves 50 axially, or may be spaced. It will be appreciated that keepers 52 may remain on bar 20 even if not used, the outer pair of keepers 52 being movable outwardly up to bolts 32 and standoffs 30, and the inner keepers 52 being movable to abut one another at the central area of the bar. In this manner, the user can engage in an exercise regime requiring the periodic change of position of grips 50, without even a momentary pause in skipping of line 22.

Weights 60, which are provided in incremental amounts, for example 1–2 pounds per disk and a maximum of 3–4 disks per end, are attached to bar 20 at the ends outside of the portion of bar 20 between standoffs 30. Accordingly, weights 60 may be axially moved clear of the bar by removing their keeper devices. Weights 60 are preferably attached by means of keeper sleeves 62, 64 for the internal and external sides of weight 60, respectively. Keepers 62, 64 are also provided with thumb screws 66, threadable through keepers 62, 64 to bear against bar 22 and thus attach keepers 62, 64 rigidly to bar 20 at their respective points of attachment, chosen by the user. Outer weight keeper sleeve 64 is preferably somewhat longer in an axial direction along bar 20 than internal sleeve 62, thumb screws 66 on outer keeper 64 being positioned asymmetrically, nearer to the end of bar 20. In this manner, the thumb screw 66 is easily engaged by the user's fingers, even when keeper 64 is abutted against weight 60. The remaining keepers 52, 62 may be relatively-narrow for example 0.5 inch, while the outer keeper 64 should be about an inch wide, as measured along the axis of bar 20, to allow easy finger access next to weight 60.

As an alternative, keepers 62, 64 can be replaced by set screw devices for the weight disks, the set screws for the weights being placed in flanges on one or more disks.

Weights 60 may be steel disks, plastic disks filled with sand, water or other fluent material, or may be other shapes adapted for positioning weights on bar 20. The extreme ends of bar 20 are capped by end plugs 70, as a means of protecting bar 20, as well as protecting anything against which bar 20 may be inadvertently moved.

Figure 5:
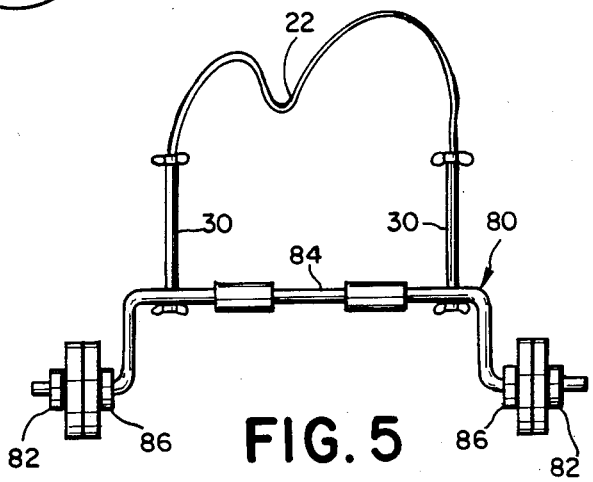
FIG. 5 is an elevation view of an alternative embodiment of the invention, the weights being radially spaced from the bar.
Figure 6:
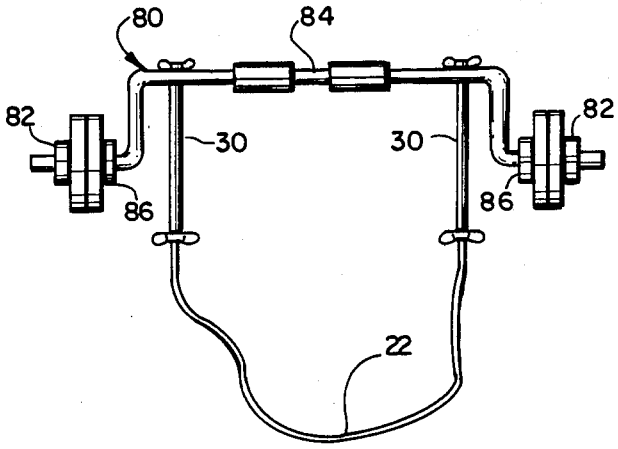
FIG. 6 is an elevation view of a further alternative embodiment.

An alternative embodiment of the invention is illustrated in FIGS. 5 and 6. As an alternative to straight bar 20, a bar 80 defining an offset axis for receiving weights can be provided, such that the user is required not only to overcome the inertia of weights on the bar to commence the rotation needed for skipping, but also to spin the weights around an axis in order to cause flexible line 22 (supported by standoffs 30 as before) to pass around the bar for jumping. Bar 80 comprises a straight central portion 84, upon which the hand grips are mounted between standoffs 30, and weight-receiving end portion 82, parallel to handle portions 84 but spaced from portion 84 by a turning radius, for example, about three inches.

The offset weighting of bar 80 as illustrated in FIGS. 5 and 6 presents a substantial challenge to the rope skipper. Furthermore, as a means of variety and complication, the phase relationship between flexible line 22 and the offset mounted weights can be changed 180 degrees, completely altering the feel of the device. The weighted bar of FIGS. 1–2 is a challenge over the typical jumprope. The offset axis bar 80 is an even more demanding exercise that stresses not only the user's cardiovascular system, but also the pectoral, arm, shoulder and back muscles, remarkably more than required in simple rope skipping, and also more than required to skip a comparable number of cycles with a straight bar.

Figure 7:
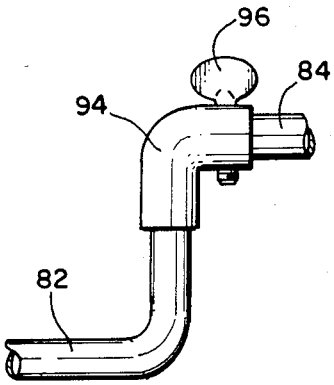
FIG. 7 is a partial elevation view illustrating the point of attachment between the bar and the radially spaced weights in FIGS. 5 and 6.

Offset axis bar 80 can be a rigid and/or monolithic bar formed, for example, by bending tubing to define the offset. In such an event, the phase relationship between the weights and rope can be changed by re-mounting standoffs 30 on the other side of the bores provided for them. It is also possible to provide a means as illustrated in FIGS. 7 in which the weight-receiving end portion 82 and the handle-sleeve portion 84 are temporarily connected, such that the user can change the phase relationship by 180 degrees by reversing the connection. Similarly, additional phase differences between the weight and rope can be provided by means of additional bores in bar 84, to be locked at various angles to weight-receiving end 82 by means of thumb screw 96.

In the embodiment shown in FIG. 7, bar 84 and bent segment 82 are connected by means of elbow 94. Elbow 94 is rigidly attached to section 82, for example by a threadable attachment or by welding. Elbow 94 is temporarily attached to bar 84 by means of thumb screw 96 which is threaded through elbow 94, passing through a bore provided in bar 84. In this manner, a variety of combinations of phase difference between the position of weights 60 and flexible line 22 are possible.

The invention having been disclosed, a number of additional variations will now occur to persons skilled in the art. Reference should be made to the appended claims rather than the foregoing specification as indicating the true scope of the subject invention.

What is claimed is:

1. An exercise device, comprising:

a bar for grasping intermediate opposite ends thereof, the bar defining an axis;

hand grips including tubes rotatable around the bar and means for axially retaining the tubes on the bar;

a plurality of weights disposed at said opposite ends of the bar, and means for axially retaining the weights on the bar;

a pair of standoff rods, each attachable to the bar by one end and aligned perpendicular to the bar, parallel to one another and spaced from said opposite ends of the bar, the rods having compression fittings at free ends remote from the bar; and a flexible line attaching said stand off rods, the flexible line being attached to said stand off rods at the compression fittings at the free ends thereof, whereby a user can exercise by simultaneously skipping the flexible line and manipulating the bar bearing said weights.

2. The device of claim 1, wherein said plurality of weights comprise removable incremental weights attachable to the opposite ends of the bar.

3. The device of claim 1, wherein said means for axially retaining the weight and said means for axially retaining the tube include collars with set screws threadable against the bar, the collars being axially fixed to the bar using the set screws and thereby axially retaining the weights and hand grips.

4. The device of claim 3, wherein said hand grips are axially fixable at a range of positions along said axis of the bar.

5. The device of claim 1, wherein said standoff rods are attached to said bar by threaded bolts, the bar having clearance holes aligned perpendicular to its longitudinal axis, the threaded bolts passing through said clearance holes and threadably urging said standoff rods endwise against the bar.

6. The device of claim 1, wherein said standoff rods are hollow, and adjustably receive a length of said flexible line within said hollow standoff rods.

7. The device of claim 6, wherein the standoff rods are slotted, tapered and threaded at the end thereof opposite said bar, and wherein the compression fittings comprise a tapered nut threadably fittable on said end.

8. The device of claim 7, wherein the standoffs rods are at least 8–10 inches long.

9. The device of claim 8, wherein the standoff rods are about 18 inches long.

10. The device of claim 1, wherein said flexible line is a solid rubber line.

11. The device of claim 2, wherein said weights are incremental weight units of about 1–2 pounds, the bar having means for receiving 3–4 weights at each end thereof.

12. The device of claim 2, wherein the weights are radially spaced from the longitudinal axis of the bar, the user rotating the weights around said longitudinal axis during skipping of the flexible line.

13. The device of claim 12, wherein the position of said weights is adjustable.

14. The device of claim 12, wherein said weights are radially spaced from said bar by about 2–6 inches.

* * * * *